US007445526B2

(12) United States Patent
Neese et al.

(10) Patent No.: US 7,445,526 B2
(45) Date of Patent: Nov. 4, 2008

(54) ELECTRICAL CONNECTOR HAVING A U-SHAPED PROTECTIVE SPRING

(75) Inventors: Christian Neese, Bielefeld (DE); Jürgen Beymann, Detmold (DE); Klaus Rabbe, Höxter (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 343 days.

(21) Appl. No.: 11/395,491

(22) Filed: Mar. 31, 2006

(65) Prior Publication Data

US 2006/0228949 A1 Oct. 12, 2006

(30) Foreign Application Priority Data

Apr. 8, 2005 (DE) ..... 20 2005 005 548 U

(51) Int. Cl.
*H01R 4/36* (2006.01)

(52) U.S. Cl. ..... 439/811; 439/806

(58) Field of Classification Search ..... 439/811, 439/806, 810, 814, 815
See application file for complete search history.

(56) References Cited

U.S. PATENT DOCUMENTS 5,190,485 A * 3/1993 Ransdell ..... 439/798
5,235,230 A * 8/1993 Yuhi et al. ..... 310/71
5,596,237 A * 1/1997 Daniels ..... 310/71
5,989,077 A * 11/1999 Mast et al. ..... 439/814
6,210,239 B1 * 4/2001 Harting et al. ..... 439/814
6,213,818 B1 * 4/2001 Chadbourne ..... 439/810
6,475,038 B1 * 11/2002 Franck ..... 439/811
RE38,384 E * 1/2004 Wong ..... 439/811
6,726,510 B2 * 4/2004 Norbert et al. ..... 439/810
6,764,355 B2 * 7/2004 Ude et al. ..... 439/811

FOREIGN PATENT DOCUMENTS

DE 198 04 702 C1 7/1999
EP 1434 312 A2 6/2004

* cited by examiner

*Primary Examiner*—Tulsidas C. Patel
*Assistant Examiner*—Harshad C Patel
(74) *Attorney, Agent, or Firm*—Lawrence E. Laubscher, Sr.; Lawrence E. Laubscher, Jr.

(57) ABSTRACT

An electrically-conductive terminal adapted for use in an electrical connector includes a horizontal upper surface containing a downwardly extending first bore in which is mounted a U-shaped protective spring. The spring has a bulging generally circular bridging portion adjacent the bottom of the first bore, and a pair of upwardly extending leg portions. One of the leg portions is adapted to be displaced by a clamping screw mounted in a threaded horizontal second bore toward clamping engagement with a bare conductor that is inserted downwardly into the first bore. The bulging bridging portion of the spring extends into diametrically opposed recesses contained in the wall of the first bore and defined by a horizontal third bore, thereby to retain the protective spring in the first bore.

14 Claims, 1 Drawing Sheet

ELECTRICAL CONNECTOR HAVING A U-SHAPED PROTECTIVE SPRING

BACKGROUND OF THE INVENTION

1. Field of the Invention

An electrically-conductive terminal adapted for use in an electrical connector includes a horizontal upper surface containing a downwardly extending first bore in which is mounted a U-shaped protective spring. The spring has a bulging generally circular bridging portion adjacent the bottom of the first bore, and a pair of upwardly extending leg portions. A clamping screw is mounted in a threaded horizontal second bore for displacing one of the leg portions toward clamping engagement with a conductor bare end that is inserted downwardly into the first bore. The bulging bridging portion of the spring extends outwardly beyond the adjacent ends of the leg portions into diametrically opposed recesses contained in the wall of the first bore and defined by a horizontal third bore, thereby to retain the protective spring in the first bore.

2. Brief Description of the Prior Art

As evidenced by the Published European Patent Application No. EP 1 434 312 A2 and the German Patent No. DE 198 04 702 C1, it is known in the prior art to provide electrical terminals with first bores for receiving the bare ends of insulated conductors, together with protective members for protecting the conductors against damage by the clamping screws that clamp the bare conductors in the first bores.

In the European published application, for example, the protective member is in the form of a U-shaped spring having a clamping leg that is clamped by the screw means against the bare conductor, and a retaining leg that has at its free extremity an outwardly bent retaining portion that extends into an opening contained in the terminal wall. In the German patent, the protective member is generally L-shaped and includes a lower leg portion provided with lateral barbs or projections that dig into the adjacent surfaces of the terminal bore. In each case, it is difficult to insert the protective member into the first bore, and often special tools are required to remove the protective members from the first bore. Moreover, there are special requirements for the material properties of this protective member, because, upon insertion into the first bore, it must be compressed relatively strongly so that adequately high restoring forces are required in order to spread the compressed legs apart from each other. This is particularly the case in the European publication in order to allow the angled retaining end to catch within the hole.

On the whole, the known protective devices are not suitable for facilitating mass production that would be optimized in terms of cost. This is a problem because typical contact elements are made as series-produced parts in large unit numbers. Problems arising during the assembly of the resilient protective spring also occur in the case of the device of the German patent, wherein the protective member is locked within the first bore by means of lateral, barb-shaped moldings in the housing part, whereby the moldings dig into the housing material. Naturally, this requires overcoming deformation forces that hinder simple and fast assembly.

The present invention was developed to provide an improved electrical terminal in which simple assembly and disassembly of the components is facilitated.

SUMMARY OF THE INVENTION

Accordingly, a primary object of the present invention is to provide an improved electrically-conductive terminal adapted for use in an electrical connector, including a body portion having a horizontal top wall containing a downwardly extending vertical first bore in which is mounted a U-shaped protective spring having a bridging portion arranged adjacent the bottom of said first bore, and a pair of upwardly extending leg portions one of which defines a clamping leg that extends across the opening of a horizontal threaded second bore that contains a clamping screw, characterized in that the spring bridging portion has a generally circular outwardly bulging configuration to extend in retaining engagement with at least one recess contained in the wall of said first bore.

According to a more specific object of the invention, the recess contained in the first bore wall is defined by the opening of a horizontal third bore that extends inwardly from an external side surface of the contact body into communication with the vertical first bore. Preferably, the third bore extends diametrically across the vertical first bore to define a second recess for receiving a second bulging part of the bridging portion.

According to a further object of the invention, the protective spring includes a shorter second retaining leg that is resiliently biased outwardly into frictional engagement with the wall of the first bore. Preferably, the free end of the second leg portion has a cross-sectional configuration that corresponds with the radius of curvature of the first bore, whereby the upper edge of the shorter leg portion frictionally engages the wall of the first bore. The longer clamping leg extends upwardly beyond the horizontal top wall surface of the terminal body.

This protective spring design of the present invention facilitates very simple assembly because the protective spring can be inserted into the conductor-receiving bore without any major force and, besides, adequate locking of the spring in the housing part is assured. One advantage provided by the design is that the two legs that adjoin the outward bulge are resiliently biased apart to extend in a spread opening action, whereby the shorter leg with a free edge will engage the wall of the conductor-receiving bore under pressure from the restoring forces that are inherent in the protective spring. The third bore extends parallel with, and from the same side of the terminal body as, the clamping screw bore, thereby simplifying the manufacture and reducing the cost of the terminal. A further advantage is that by a single manufacturing step, the third bore is caused to extend completely across the first bore into the opposite wall area of the housing part, whereby the tip of the third bore forms yet another lateral recess into which the outward bulge protrudes so that the protective spring rests upon two mutually opposite sides, thereby securing the spring against both axial and rotational displacement.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 6:
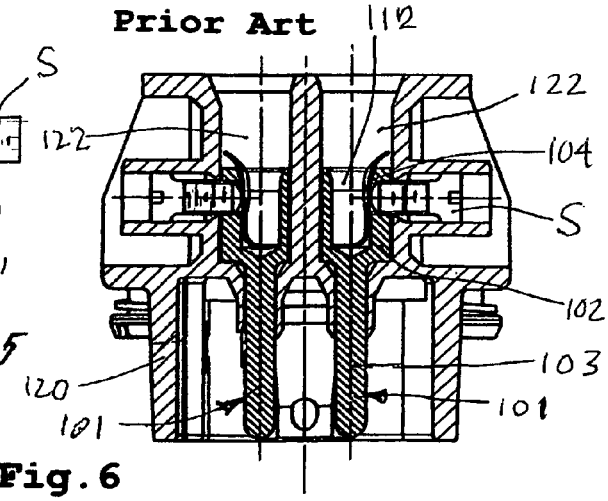
FIG. 6 is a sectional view of a connector and terminal assembly of the patented prior art, as illustrated by the German patent No. DE 198 04 702 C1.

Referring first more particularly to FIG. 6, as shown by the aforementioned German patent No. DE 198 04 702 C1, it is known to provide an electrical connector 120 formed from an electrically-insulating synthetic plastic material having chambers 122 that receive a pair of male terminals. Each terminal includes a body portion 102 and a male pin portion 103. The body portion contains a downwardly extending bore 112 that receives an L-shaped protective member 104 that is biased by clamping spring S into clamping engagement with the bare end of an insulated conductor (not shown) that is inserted downwardly into the bore 112 via the conductor opening 122.

Figure 1:
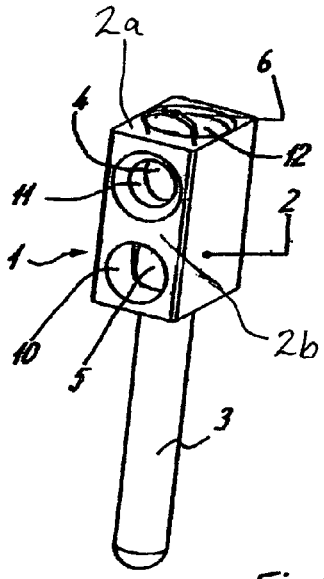
FIG. 1 is a perspective view of the electrical terminal of the present invention.
Figure 2:
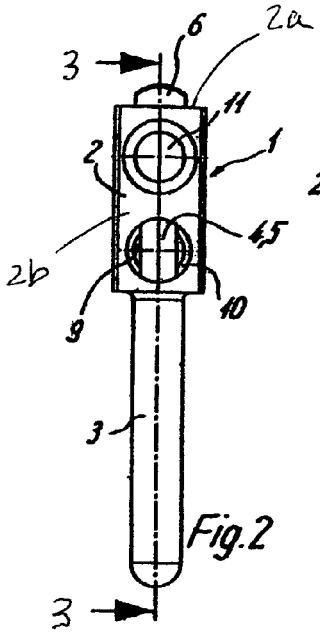
FIG. 2 is a front elevation view of the terminal of FIG. 1.
Figure 4:
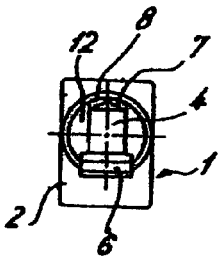
FIG. 4 is a top view of the terminal of FIG. 2.

Referring now to FIG. 1, the electrically conductive terminal 1 of the present invention includes a generally rectangular upper body portion 2, and an integral downwardly extending contact portion 3. The horizontal top surface 2*a* of the body portion contains a downwardly extending first bore 12 into which is downwardly inserted a resilient flat U-shaped protective spring 4 having a bridging portion 5 seated at the bottom of the first bore 12, and a pair of upwardly extending vertical leg portions 6 and 7. The first leg portion 6 is longer than the second leg portion 7 and serves as a clamping leg extends across the opening of a horizontal threaded second bore 11 that extends inwardly from the body side wall 2*b* into communication with the vertical first bore 12. Threadably mounted in the second bore is a clamping screw S arranged to engage the longer spring leg portion 6. The upper extremity of the longer spring leg portion 6 projects upwardly beyond the top surface 2*a* of the terminal body. The shorter leg portion 7 comprises a retaining leg the upper extremity of which has a curved cross-sectional configuration that corresponds with the curved wall surface of the first bore 12, as shown in FIG. 4. The spring leg portions are resiliently biased apart so that the top edge 8 of the second leg portion 7 is biased into frictional engagement with the wall of bore 12, and the first leg portion is biased toward the opening of the screw bore 10. As shown in FIG. 2, the leg portions of the spring flare outwardly relative to their junctions with the bridging portion 5.

In accordance with a characterizing feature of the present invention, in order to retain the protective spring 4 within the vertical first bore 12, the bridging portion 5 of the spring has a generally circular bulging configuration that extends outwardly beyond the adjacent lower extremities of the spring leg portions 6 and 7. Thus, the diameter of the generally circular bridging portion 5 is greater than the spacing distance between the lower extremities of the spring leg portions 6 and 7. A first bulging part of the bridging portion 5 extends into the mouth of a horizontal third bore 10 that extends inwardly from the side wall 2*b* below the second bore 11. This third bore extends across the vertical first bore to define a recess 9 in the first bore wall for receiving a diametrically opposed second bulging part of the bridging portion 5.

Figure 3:
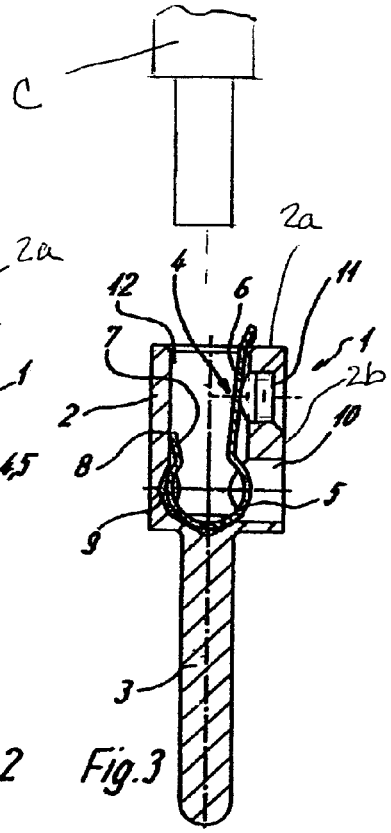
FIG. 3 is a sectional view taken along the line 3-3 of FIG. 2.

To connect the bare end of an insulated conductor C (FIG. 3) to the terminal 2, the bare end is inserted downwardly into the first bore 12 until the conductor lower extremity abuts the spring bridging portion at the bottom of the first bore. The installer then rotates the clamping screw S by a screwdriver or the like to clamp the first spring leg 6 against the conductor, and to clamp the conductor against the diametrically opposite portion of the bore wall, whereupon the upper edge 8 of the outwardly flared second spring leg 7 is forced into frictional engagement with the bore wall. Consequently, the conductor bare end is rigidly clamped within the terminal body, and withdrawal of the conductor and the protective spring 4 from the first bore 12 is positively resisted.

Figure 5:
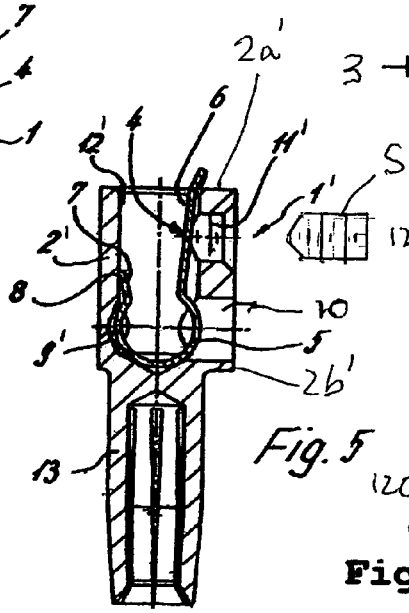
Fig.5 Prior Art
FIG. 5 is a sectional view of a modification of the invention of FIG. 3.

As is known in the art, the terminal contact portion 3 of the embodiment of FIGS. 1 to 4 is in the form of a solid male pin. In the modification of FIG. 5, the downward extension portion 13 comprises a female socket. In either case, the terminals are adapted for mounting in the synthetic plastic body of an electrical connector in the manner of the German patent No. DE 198 04 702 C1, as illustrated in FIG. 6.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. An electrical terminal adapted for use in a connector, comprising:

(a) an electrically conductive terminal body (2) having a horizontal top wall (2*a*) and at least one vertical side wall, said body containing a conductor-receiving first bore (12) that extends downwardly from said top wall, and an internally threaded second bore (11) that extends horizontally from said one vertical side wall into communication with said first bore;

(b) a generally U-shaped protective spring (4) mounted in said first bore, said spring having a bridging portion (5) adjacent the bottom of said first bore, and a pair of upwardly extending leg portions (6,7) that extend vertically upwardly from said bridging portion, one of said leg portions (6) extending across the adjacent opening of said second bore, said spring bridging portion having a generally circular convex configuration that bulges outwardly beyond the adjacent lower extremities of said spring leg portions into engagement with at least one recess (9, 10) contained in the side wall of said first bore, thereby to retain said protective spring in said first bore; and (c) a clamping screw (S) threadably mounted in said second bore, said clamping screw being operable, when a bare conductor is inserted downwardly within said first bore, to clamp said first spring leg against the conductor.

2. An electrical terminal as defined in claim 1, wherein said spring legs are normally resiliently biased apart.

3. An electrical terminal as defined in claim 2, wherein the second leg portion (7) of said protective spring has a length that is shorter than the length of said first spring leg portion, said second leg portion terminating in an upper edge (8) that is biased into frictional engagement with the wall of said first bore.

4. An electrical terminal as defined in claim 3, wherein the upper free end of said second spring leg portion has a curved cross-sectional configuration that corresponds with the curved configuration of the associated wall portion of said first bore.

5. An electrical terminal as defined in claim 4, wherein said upper edge of said second leg portion terminates at a lower height than said horizontal second bore, whereby the bare conductor is clamped against the wall of said first bore.

6. An electrical terminal as defined in claim 1, wherein the wall of said first bore contains a pair of opposed recesses (9,10) that receive the diametrically opposed bulging portions of said spring bridging portion.

7. An electrical terminal as defined in claim 6, wherein one of said recesses comprises a horizontal third bore (10) that extends inwardly from said terminal body one vertical side wall.

8. An electrical terminal as defined in claim 7, wherein other of said recesses (9) is formed by an extension of said third bore diametrically opposite the mouth of said third bore.

9. An electrical terminal as defined in claim 8, wherein said third bore is arranged below and parallel with said second bore.

10. An electrical terminal as defined in claim 1, wherein the lower extremity of said spring bridging portion is seated on the bottom of said first bore.

11. An electrical terminal as defined in claim 1, wherein said contact body includes an integral contact portion that extends downwardly from said contact body.

12. An electrical terminal as defined in claim 11, wherein said contact portion comprises a contact pin (3).

13. An electrical terminal as defined in claim 11, wherein said contact portion comprises a hollow contact socket (13).

14. An electrical terminal as defined in claim 1, wherein said one spring leg portion extends upwardly beyond the horizontal top surface of said contact body portion.

* * * * *